US008427465B2

(12) United States Patent
Kitayama et al.

(10) Patent No.: US 8,427,465 B2
(45) Date of Patent: Apr. 23, 2013

(54) DISPLAYING DEVICE, ITS DRIVING CIRCUIT AND ITS DRIVING METHOD

(75) Inventors: Masae Kitayama, Tsu (JP); Fumikazu Shimoshikiryoh, Matsusaka (JP); Kentaro Irie, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 1160 days.

(21) Appl. No.: 12/308,577

(22) PCT Filed: Apr. 12, 2007

(86) PCT No.: PCT/JP2007/058044

§ 371 (c)(1),
(2), (4) Date: Dec. 18, 2008

(87) PCT Pub. No.: WO2008/035476

PCT Pub. Date: Mar. 27, 2008

(65) Prior Publication Data

US 2010/0238151 A1 Sep. 23, 2010

(30) Foreign Application Priority Data

Sep. 19, 2006 (JP) ..... 2006-252099

(51) Int. Cl.
*G09G 5/00* (2006.01)

(52) U.S. Cl.
USPC ..... 345/209; 345/90; 345/100

(58) Field of Classification Search ..... 345/87, 345/90, 92, 94, 96, 97, 99, 209
See application file for complete search history.

(56) References Cited

U.S. PATENT DOCUMENTS

| | | | | |
|---|---|---|---|---|
| 8,223,103 | B2 * | 7/2012 | Kim et al. | 345/94 |
| 2001/0043178 | A1 | 11/2001 | Okuzono et al. | |
| 2004/0017344 | A1 | 1/2004 | Takemoto | |
| 2004/0021625 | A1 | 2/2004 | Lee | |
| 2004/0178981 | A1 | 9/2004 | Asada et al. | |
| 2005/0110737 | A1 | 5/2005 | Hosotani | |
| 2005/0162372 | A1 | 7/2005 | Hashimoto | |

(Continued)

FOREIGN PATENT DOCUMENTS

| | | |
|---|---|---|
| CN | 1530723 | 9/2004 |
| CN | 1619635 | 5/2005 |

(Continued)

OTHER PUBLICATIONS

Office Action for corresponding Chinese patent application No. 200780034237X issued on Feb. 21, 2011 (in English).

*Primary Examiner* — Amare Mengistu
*Assistant Examiner* — Premal Patel
(74) *Attorney, Agent, or Firm* — Harness, Dickey & Pierce, P.L.C.

(57) ABSTRACT

Provided are a display device which may be capable of eliminating display irregularities due to the difference in the charging rate between lines, while preventing increase in heat generation and power consumption by the device, and a circuit and method for driving the same. In a liquid crystal display device employing both a 2-line dot-inversion drive method and a charge-sharing method, a charge-sharing period (TB) within a horizontal scanning period (2H period) in which the polarity of each data signal is the same as that in one horizontal scanning period previous thereto, is set to be longer than a charge-sharing period (TA) within a horizontal scanning period (1H period) in which the polarity of each data signal is different from that in one horizontal scanning period previous thereto. Thus, a charge period within the 2H period can be shorter than that within the 1H period.

12 Claims, 8 Drawing Sheets

U.S. PATENT DOCUMENTS

| | | | |
|---|---|---|---|
| 2006/0001630 | A1 | 1/2006 | Chen et al. |
| 2006/0125752 | A1 | 6/2006 | Moh |

FOREIGN PATENT DOCUMENTS

| | | |
|---|---|---|
| JP | 11-095729 | 4/1999 |
| JP | 2001-215469 | 8/2001 |
| JP | 2002-287701 | 10/2002 |
| JP | 2003-337577 | 11/2003 |
| JP | 2004-61590 | 2/2004 |
| JP | 2005-156661 | 6/2005 |
| JP | 2005-195986 | 7/2005 |

* cited by examiner

Fig.7

| | | | | | |
|---|---|---|---|---|---|
| + | − | + | − | + | − |
| − | + | − | + | − | + |
| + | − | + | − | + | − |
| − | + | − | + | − | + |

Fig.8

| | | | | | |
|---|---|---|---|---|---|
| + | − | + | − | + | − |
| + | − | + | − | + | − |
| − | + | − | + | − | + |
| − | + | − | + | − | + |

CONVENTIONAL ART

DISPLAYING DEVICE, ITS DRIVING CIRCUIT AND ITS DRIVING METHOD

TECHNICAL FIELD

The present invention relates to display devices, and particularly to an active matrix-type display device employing as drive methods a multi-line dot-inversion drive method and a charge-sharing method.

BACKGROUND ART

In recent years, active matrix-type liquid crystal display devices including TFTs (thin film transistors) as switching elements have been known. Such a liquid crystal display device includes a liquid crystal panel having two insulating substrates opposed to each other. One substrate of the liquid crystal panel has gate bus lines (scanning signal lines) and source bus lines (video signal lines) provided thereon in a lattice pattern, while having the TFTs provided in the vicinities of intersections of the gate bus lines and the source bus lines. The TFTs each have a gate electrode branched from the gate bus line, a source electrode branched from the source bus line, and a drain electrode. The drain electrodes are connected to pixel electrodes arranged in a matrix on the substrate for image formation. The other substrate of the liquid crystal panel has an electrode (hereinafter, referred to as a "counter electrode") provided thereon for applying voltage between a liquid crystal layer and the pixel electrodes via the liquid crystal layer, such that each pixel is formed by the pixel electrode, the counter electrode, and the liquid crystal layer. Note that such an area in which a single pixel is formed is referred to as a "pixel formation portion" for convenience. Voltage is applied to the pixel formation portion based on a video signal (data signal) received by the source electrode of the TFT from the source bus line when the gate electrode of each TFT receives an active scanning signal (gate signal) from the gate bus line. The pixel formation portion has formed therein a pixel capacitance. Voltage indicating a pixel value is held in the pixel capacitance.

Incidentally, liquid crystals have the property of deteriorating when DC voltage is continuously applied thereto. Therefore, in the case of liquid crystal display devices, AC voltage is applied to the liquid crystal layer. Application of the AC voltage to the liquid crystal layer is achieved by inverting the polarity of voltage being applied to each pixel formation portion every frame period, i.e., by inverting the polarity of source electrode voltage conforming with the potential of the counter electrode every frame period. Note that the voltage being applied to the pixel formation portion is referred to below as "pixel voltage". As a technology for implementing the application of the AC voltage to the liquid crystal layer, a drive method is known in which the polarity of the pixel voltage is inverted every frame period, and polarities are also inverted within one frame period between adjacent pixels along the direction in which the gate bus lines extend and along the direction in which the source bus lines extend. Such a drive method is referred to as "dot-inversion drive". FIG. 7 is a polarity diagram showing the polarities of pixel voltage being applied to pixel formation portions on a display screen during a given frame period in a liquid crystal display device employing the dot-inversion drive method. As shown in FIG. 7, the polarity of the pixel voltage is inverted between all adjacent pixels.

However, the conventional dot-inversion drive has such problems as increased power consumption and increased heat generation because the polarity of the pixel voltage is inverted every gate bus line. Accordingly, there has been proposed a drive method in which the polarity of the pixel voltage is inverted every two gate bus lines, and furthermore, the polarity inversion is also performed between adjacent pixels along the direction in which the gate bus lines extend. Such a drive method is referred to as "2-line dot-inversion drive (2H dot-inversion drive)". FIG. 8 is a polarity diagram showing polarities of pixel voltage being applied to pixel formation portions on a display screen during a given frame period in a liquid crystal display device employing the 2-line dot-inversion drive. In the case of this liquid crystal display device, the polarity of the pixel voltage is inverted every two gate bus lines, and therefore power consumption and heat generation are reduced compared to the drive method in which the polarity of the pixel voltage is inverted every gate bus line.

Also, there has been proposed a liquid crystal display device employing a charge-sharing method in which short circuit is caused to occur between adjacent source bus lines for a predetermined time period from the start of each horizontal scanning period in order to further reduce power consumption. In the case of the liquid crystal display device employing the dot-inversion drive method (including the 2-line dot-inversion drive method), adjacent source bus lines are opposite in voltage polarity to each other, and furthermore, for full-white and full-gray screen display patterns, their voltage absolute values are almost equal. Accordingly, in the case of a normally-black type, short circuit between adjacent source bus lines causes voltage on each source bus line to conform with voltage corresponding to black display. Note that the voltage corresponding to black display is referred to below as "black voltage".

However, in the case of employing the charge-sharing method for a 2-line dot-inversion drive liquid crystal display device, a stripe might be visually recognized on every line on the display screen. This will be described with reference to FIG. 9. In FIGS. 9A to 9E are signal waveform diagrams where white display is being performed in a normally-black type liquid crystal display device employing both the 2-line dot-inversion drive method and the charge-sharing method. FIGS. 9A to 9C show gate signal waveforms, FIG. 9D shows a waveform of short-circuit control signal for causing short circuit between adjacent source bus lines, and FIG. 9E shows a data signal waveform. Note that hereinafter, a horizontal scanning period in which the polarity of a data signal S(i) is inverse relative to that of one horizontal scanning period previous thereto is referred to as a "1H period", and the next horizontal scanning period is referred to as a "2H period". In addition, reference character Vc denotes a midpoint potential of the data signal S(i).

In the 1H period, short circuit occurs between adjacent source bus lines during a period in which the logic level of a short-circuit control signal Csh is high (hereinafter, referred to as a "charge-sharing period"). As a result, the voltage of the data signal S(i), which corresponds to white display, approximates black voltage. Note that the voltage corresponding to white display is referred to below as "white voltage". After the charge-sharing period, the voltage of the data signal S(i) rises to white voltage. Thereafter, when the charge-sharing period starts in the 2H period, the voltage of the data signal S(i), which is white voltage, approximates black voltage.

Here, looking at the voltage of the data signal S(i) after the charge-sharing period both in the 1H and 2H periods, the voltage in the 1H period is negative, whereas the voltage in the 2H period is positive. This is because it is not possible to ensure enough time to allow the charge-sharing period to completely change the voltage of the data signal S(i) from white voltage to black voltage. Therefore, the time required for the voltage of the data signal S(i) to reach white voltage after the charge-sharing period is longer in the 1H period than in the 2H period. As a result, the charging rate for the pixel capacitance of the pixel formation portion charged in the 2H period (hereinafter, simply referred to as the "2H period charging rate") becomes higher than the charging rate for the pixel capacitance of the pixel formation portion charged in the 1H period (hereinafter, simply referred to as the "1H period charging rate"). Thus, a line (row) with a relatively high charging rate and a line (row) with a relatively low charging rate occur alternately, and are visually recognized as stripes on the entire display screen. Note that the charging rate is represented by a proportion of voltage actually generated at the drain electrode (connected to the pixel electrode of the pixel formation portion) to voltage applied to the source bus line.

For example, Japanese Laid-Open Patent Publication Nos. 2003-337577 and 2005-156661 disclose inventions of a liquid crystal display devices in which the pulse width of the gate signal is adjusted to control the charging rate in order to eliminate such a display defect due to the above difference in the charging rate between the 1H and 2H periods. In addition, Japanese Laid-Open Patent Publication No. 2004-61590 discloses an invention of a liquid crystal display device in which conditions for the rise of drain waveforms during horizontal scanning periods are equalized by resetting a source driver output during a blanking period in each horizontal scanning period.

[Patent Document 1] Japanese Laid-Open Patent Publication No. 2003-337577

[Patent Document 2] Japanese Laid-Open Patent Publication No. 2005-156661

[Patent Document 3] Japanese Laid-Open Patent Publication No. 2004-61590

DISCLOSURE OF THE INVENTION

Problems to be Solved by the Invention

However, the inventions disclosed in Japanese Laid-Open Patent Publication Nos. 2003-337577 and 2005-156661 are not directed to display devices employing the charge-sharing method. In addition, according to Japanese Laid-Open Patent Publication No. 2004-61590, the drain potential reaches the midpoint potential during the blanking period, but in fact, the drain voltage might not reach the midpoint potential depending on the length of the blanking period, and therefore it is conceivably difficult to ensure that the blanking period is sufficiently long to allow the drain potential to reach the midpoint potential.

Therefore, the present invention aims to provide a display device capable of eliminating display irregularities due to the difference in the charging rate between lines, while preventing increase in heat generation and power consumption by the device, and also to provide a circuit and method for driving the same.

Solution to the Problems

A first aspect of the present invention is directed to an active matrix-type display device including:

a plurality of video signal lines for respectively transmitting a plurality of video signals representing an image to be displayed;

a plurality of scanning signal lines crossing the video signal lines;

a plurality of pixel formation portions arranged in a matrix in association with intersections of the video signal lines and the scanning signal lines;

a video signal line drive circuit for supplying the video signals to the video signal lines such that video signals being applied to adjacent video signal lines have different polarities, and the polarity of each video signal is inverted per a plurality of horizontal scanning periods within each frame period;

a scanning signal line drive circuit for sequentially selecting the scanning signal lines per a predetermined horizontal scanning period within each frame period; and an adjacent video signal line short-circuit portion provided inside or outside the video signal line drive circuit to short-circuit the adjacent video signal lines for a preset charge-sharing period from the start of each horizontal scanning period, wherein a second charge-sharing period, which is the charge-sharing period within a horizontal scanning period in which the polarity of each video signal is different from that in one horizontal scanning period previous thereto, is longer in time than a first charge-sharing period, which is the charge-sharing period within a horizontal scanning period in which the polarity of each video signal is the same as that in one horizontal scanning period previous thereto.

In a second aspect of the present invention, based on the first aspect of the invention, the second charge-sharing period is set to be less than or equal to twice the length of the first charge-sharing period.

In a third aspect of the present invention, based on the first aspect of the invention, the video signal line drive circuit supplies the video signals to the video signal lines such that the polarity of each video signal is inverted per two horizontal scanning periods within each frame period.

In a fourth aspect of the present invention, based on the first aspect of the invention, the first charge-sharing period and the second charge-sharing period are set such that a charging rate for each pixel formation portion during the horizontal scanning period in which the polarity of each video signal is the same as that in one horizontal scanning period previous thereto is equal to a charging rate for the pixel formation portion during the horizontal scanning period in which the polarity of each video signal is different from that in one horizontal scanning period previous thereto.

A fifth aspect of the present invention is directed to a drive circuit for an active matrix-type display device including: a plurality of video signal lines for respectively transmitting a plurality of video signals representing an image to be displayed; a plurality of scanning signal lines crossing the video signal lines; and a plurality of pixel formation portions arranged in a matrix in association with intersections of the video signal lines and the scanning signal lines, the circuit including:

a video signal line drive circuit for supplying the video signals to the video signal lines such that video signals being applied to adjacent video signal lines have different polarities, and the polarity of each video signal is inverted per a plurality of horizontal scanning periods within each frame period;

a scanning signal line drive circuit for sequentially selecting the scanning signal lines per a predetermined horizontal scanning period within each frame period; and an adjacent video signal line short-circuit portion for short-circuiting the adjacent video signal lines for a preset charge-sharing period from the start of each horizontal scanning period, wherein a second charge-sharing period, which is the charge-sharing period within a horizontal scanning period in which the polarity of each video signal is different from that in one horizontal scanning period previous thereto, is longer in time than a first charge-sharing period, which is the charge-sharing period within a horizontal scanning period in which the polarity of each video signal is the same as that in one horizontal scanning period previous thereto.

In a sixth aspect of the present invention, based on the fifth aspect of the invention, the second charge-sharing period is set to be less than or equal to twice the length of the first charge-sharing period.

In a seventh aspect of the present invention, based on the fifth aspect of the invention, the video signal line drive circuit supplies the video signals to the video signal lines such that the polarity of each video signal is inverted per two horizontal scanning periods within each frame period.

In an eighth aspect of the present invention, based on the fifth aspect of the invention, the first charge-sharing period and the second charge-sharing period are set such that a charging rate for each pixel formation portion during the horizontal scanning period in which the polarity of each video signal is the same as that in one horizontal scanning period previous thereto is equal to a charging rate for the pixel formation portion during the horizontal scanning period in which the polarity of each video signal is different from that in one horizontal scanning period previous thereto.

A ninth aspect of the present invention is directed to a drive method for an active matrix-type display device including: a plurality of video signal lines for respectively transmitting a plurality of video signals representing an image to be displayed; a plurality of scanning signal lines crossing the video signal lines; and a plurality of pixel formation portions arranged in a matrix in association with intersections of the video signal lines and the scanning signal lines, the method including:

a video signal line drive step of supplying the video signals to the video signal lines such that video signals being applied to adjacent video signal lines have different polarities, and the polarity of each video signal is inverted per a plurality of horizontal scanning periods within each frame period;

a scanning signal line drive step of sequentially selecting the scanning signal lines per a predetermined horizontal scanning period within each frame period; and an adjacent video signal line short-circuit step of short-circuiting the adjacent video signal lines for a preset charge-sharing period from the start of each horizontal scanning period, wherein a second charge-sharing period, which is the charge-sharing period within a horizontal scanning period in which the polarity of each video signal is different from that in one horizontal scanning period previous thereto, is longer in time than a first charge-sharing period, which is the charge-sharing period within a horizontal scanning period in which the polarity of each video signal is the same as that in one horizontal scanning period previous thereto.

In a tenth aspect of the present invention, based on the ninth aspect of the invention, the second charge-sharing period is set to be less than or equal to twice the length of the first charge-sharing period.

In an eleventh aspect of the present invention, based on the ninth aspect of the invention, in the video signal line drive step, the video signals are supplied to the video signal lines such that the polarity of each video signal is inverted per two horizontal scanning periods within each frame period.

In a twelfth aspect of the present invention, based on the ninth aspect of the invention, the first charge-sharing period and the second charge-sharing period are set such that a charging rate for each pixel formation portion during the horizontal scanning period in which the polarity of each video signal is the same as that in one horizontal scanning period previous thereto is equal to a charging rate for the pixel formation portion during the horizontal scanning period in which the polarity of each video signal is different from that in one horizontal scanning period previous thereto.

Effect of the Invention

According to the first aspect of the present invention, in an active matrix-type display device employing both multi-line dot-inversion drive method and a charge-sharing method, the charge-sharing period within or after the 2H period (the horizontal scanning period in which the polarity of each video signal is the same as that in one horizontal scanning period pervious thereto) is set to be longer than the charge-sharing period within the 1H period (the horizontal scanning period in which the polarity of each video signal is different from that in one horizontal scanning period pervious thereto). Accordingly, the charge period for pixel formation portions to be charged in or after the 2H period is shorter than the charge period for pixel formation portions to be charged in the 1H period. In addition, the voltage of each video signal at the beginning of charging in the 2H period is lower than conventionally. Thus, the charging rate in and after the 2H period becomes lower than conventionally, eliminating display irregularities due to the charging rate being higher in and after the 2H period than in the 1H period.

According to the second aspect of the present invention, in the active matrix-type display device employing both the multi-line dot-inversion drive method and the charge-sharing method, a charge period for the pixel formation portions to be charged in or after the 2H period is sufficiently ensured. Thus, an adjustment between the charging rate for the 1H period and the charging rate for the 2H periods is performed to prevent the charging rate from becoming excessively low in and after the 2H period.

According to the third aspect of the present invention, in an active matrix-type display device employing both a 2-line dot-inversion drive method and the charge-sharing method, the charge-sharing period is set to be longer in the 2H period than in the 1H period. Thus, as in the first aspect of the present invention, display irregularities due to the charging rate being higher in the 2H period than in the 1H period are eliminated.

According to the fourth aspect of the present invention, the charge-sharing period is set such that the charging rate for the 1H period is equal to the charging rate for the 2H and subsequent periods. Thus, display irregularities due to the charging rate being higher in and after the 2H period than in the 1H period are reliably eliminated.

BRIEF DESCRIPTION OF THE DRAWINGS

FIG. 7 is a polarity diagram showing the polarities of pixel voltage being applied to pixel formation portions in a liquid crystal display device employing a dot-inversion drive method.

FIG. 8 is a polarity diagram showing the polarities of pixel voltage being applied to pixel formation portions in a liquid crystal display device employing a 2-line dot-inversion drive method.

DESCRIPTION OF THE REFERENCE CHARACTERS

10: TFT (switching element)
31: buffer (voltage follower)
100: display portion
200: display control circuit
300: source driver (video signal line drive circuit)
400: gate driver (scanning signal line drive circuit)
Cp: pixel capacitance
SLi: source bus line (data signal line) (where i=1, 2, . . . , n)
GLj: gate bus line (scanning signal line) (where j=1, 2, . . . , m)
Csh: short-circuit control signal
Csh1: first short-circuit control signal
Csh2: second short-circuit control signal
S(i): data signal (where i=1, 2, . . . , n)
G(j): gate signal (where j=1, 2, . . . , m)

BEST MODE FOR CARRYING OUT THE INVENTION

Hereinafter, an embodiment of the present invention will be described with reference to the accompanying drawings.

<1. Overall Configuration and Operation>

Figures 1A, 1B, 1C, 1D, 1E:
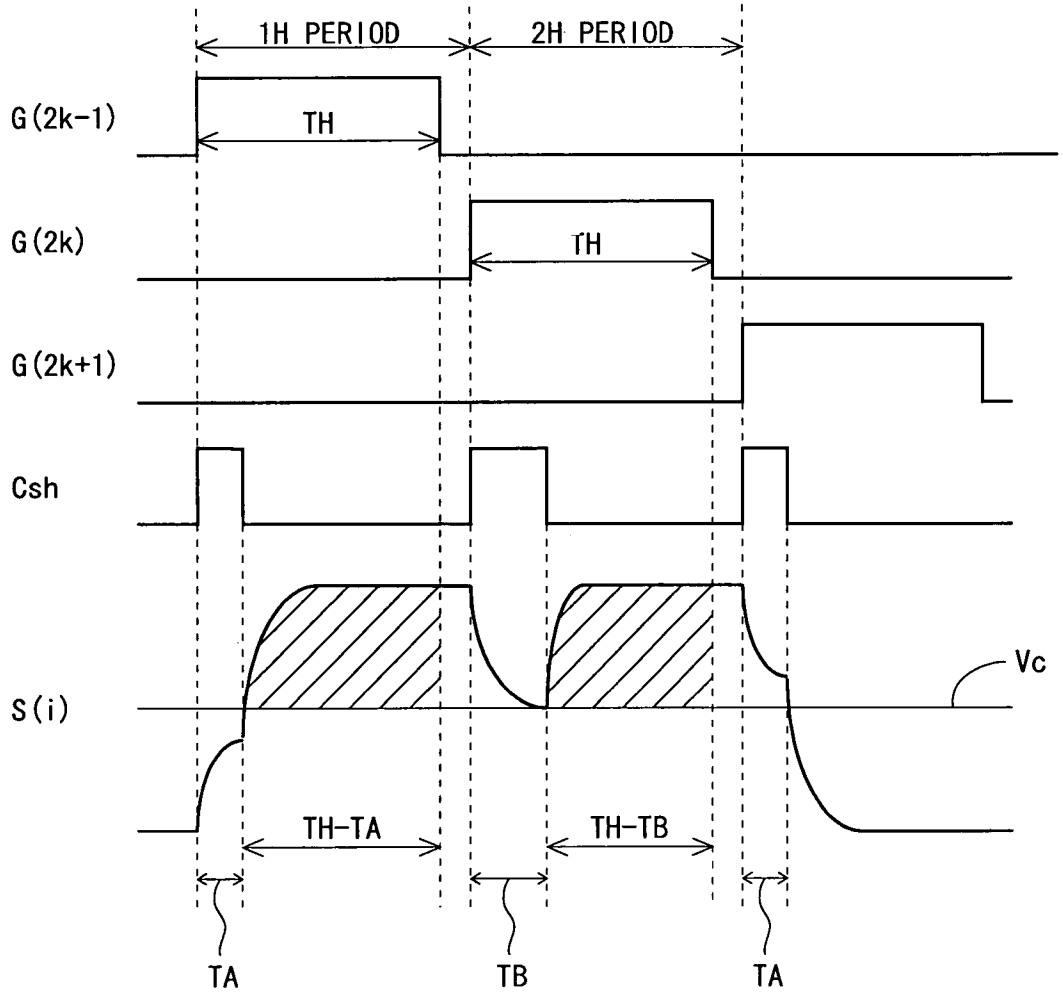
FIGS. 1A to 1E are signal waveform diagrams where white display is being performed in a liquid crystal display device according to an embodiment of the present invention.
Figure 2:
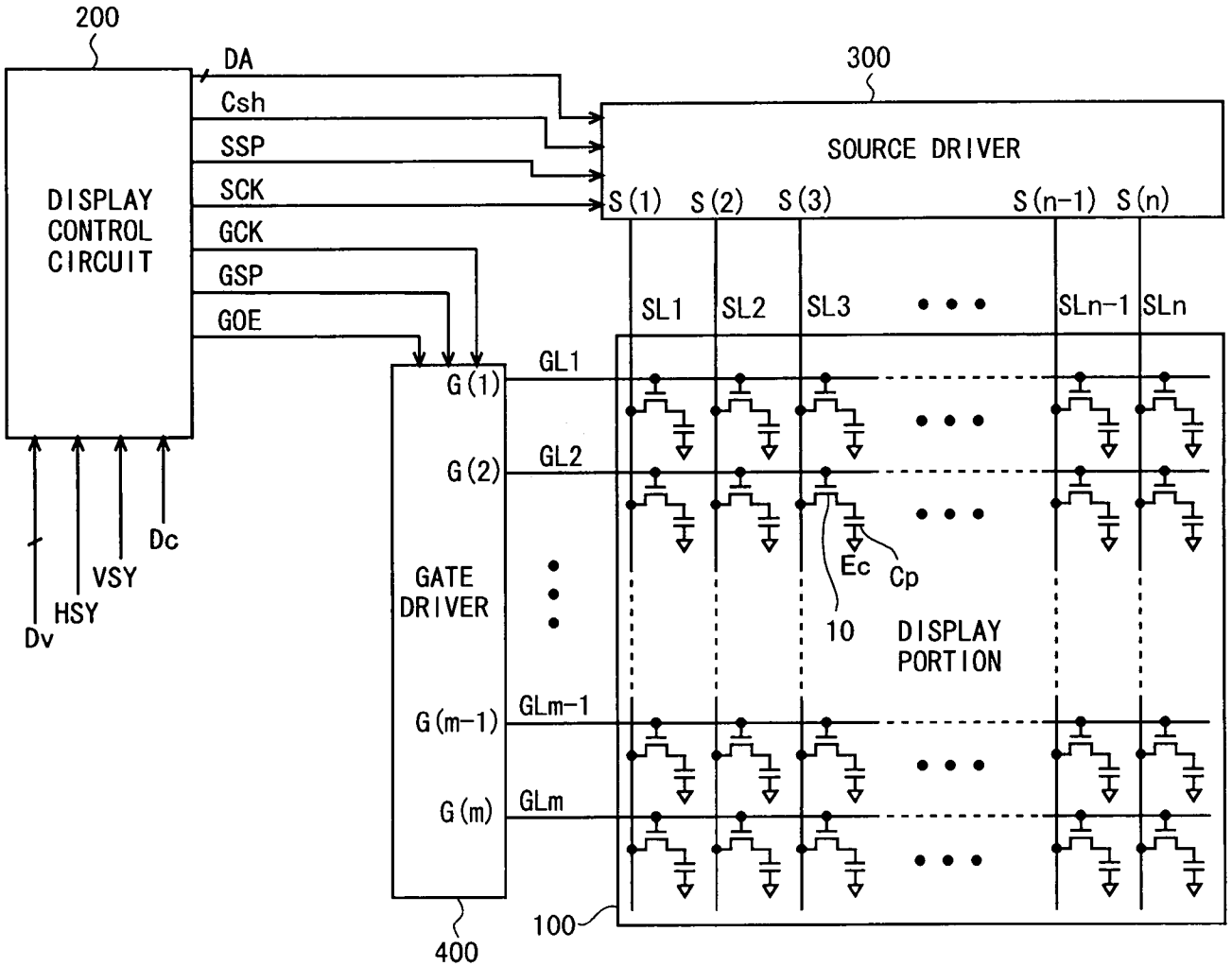
FIG. 2 is a block diagram illustrating the configuration of the liquid crystal display device according to the embodiment, along with an equivalent circuit of its display portion.

FIG. 2 is a block diagram illustrating the configuration of a liquid crystal display device according to the present embodiment, along with an equivalent circuit of its display portion. This liquid crystal display device includes a source driver (video signal line drive circuit) 300, a gate driver (scanning signal line drive circuit) 400, an active matrix-type display portion 100, and a display control circuit 200 for controlling the source driver 300 and the gate driver 400. Note that descriptions will be given on the assumption that the liquid crystal display device is of a normally-black type.

The display portion 100 in the present embodiment includes a plurality (m) of gate bus lines (scanning signal lines) GL1 to GLm, a plurality (n) of source bus lines (video signal lines) SL1 to SLn crossing each of the gate bus lines GL1 to GLm, and a plurality (n×m) of pixel formation portions provided at corresponding intersections of the gate bus lines GL1 to GLm and the source bus lines SL1 to SLn. The pixel formation portions are arranged in a matrix to constitute a pixel array. Each pixel formation portion consists of: a TFT 10, which is a switching element having a gate terminal connected to the gate bus line GLj passing its corresponding intersection and a source terminal connected to the source bus line SLi passing the intersection; a pixel electrode connected to a drain terminal of the TFT 10; a common electrode Ec, which is a counter electrode commonly provided for the pixel formation portions; and a liquid crystal layer commonly provided for the pixel formation portions and interposed between the pixel electrode and the common electrode Ec. Furthermore, a pixel capacitance Cp is configured by a liquid crystal capacitance formed by the pixel electrode and the common electrode Ec.

The pixel electrode in each pixel formation portion is provided with a potential by the source driver 300 and the gate driver 400 operating as will be described later, in accordance with an image to be displayed. The common electrode Ec is provided with a predetermined potential (common electrode potential) Vcom from an unillustrated power supply circuit. As a result, voltage is applied to the liquid crystal in accordance with the difference in potential between the pixel electrode and the common electrode Ec. The voltage application controls the amount of light transmitted through the liquid crystal layer, thereby allowing the image to be displayed.

The display control circuit 200 receives from an external signal source a digital video signal Dv, which represents an image to be displayed, a horizontal synchronization signal HSY and a vertical synchronization signal VSY, which correspond to the digital video signal Dv, and a control signal Dc for controlling a display operation. The display control circuit 200 then generates and outputs the following signals: data start pulse signal SSP; data clock signal SCK; short-circuit control signal Csh; digital image signal DA (a signal corresponding to the video signal Dv), which represents the image to be displayed; gate start pulse signal GSP; gate clock signal GCK; and gate driver output control signal GOE, in order to cause the image represented by the digital video signal Dv to be displayed on the display portion 100 based on the signals Dv, HSY, VSY, and Dc. More specifically, the display control circuit 200 outputs the video signal DV as the digital image signal DA after performing as necessary, for example, timing adjustments within internal memory, and generates the following signals: data clock signal SCK, which is a signal composed of pulses corresponding to pixels for the image represented by the digital image signal DA; data start pulse signal SSP, which is a signal to be brought into high level (H level) for a predetermined period every horizontal scanning period based on the horizontal synchronization signal HSY; gate start pulse signal GSP, which is a signal to be brought into H level for a predetermined period within one frame period (one vertical scanning period) based on the vertical synchronization signal VSY; gate clock signal GCK based on the horizontal synchronization signal HSY; and short-circuit control signal Csh and gate driver output control signal GOE based on the horizontal synchronization signal HSY and the control signal Dc.

Of the signals thus generated in the display control circuit 200, the digital image signal DA, the short-circuit control signal Csh, the data start pulse signal SSP, and the data clock signal SCK are inputted to the source driver 300, whereas the gate start pulse signal GSP, the gate clock signal GCK, and the gate driver output control signal GOE are inputted to the gate driver 400.

Based on the digital image signal DA, the data start pulse signal SSP, and the data clock signal SCK, the source driver 300 sequentially generates data signals S(1) to S(n), each being analog voltage that corresponds to a pixel value for one line, every horizontal scanning period, and applies the data signals S(1) to S(n) to the source bus lines SL1 to SLn, respectively. The source driver 300 in the present embodiment employs a drive method in which the data signals S(1) to S(n) are outputted such that the polarity of the voltage being applied to the liquid crystal layer is inverted every frame period in such a manner as to be inverted every two gate bus lines in the frame period, and the polarity is also inverted between adjacent pixels along the direction in which the gate bus lines extend, that is, the 2-line dot-inversion drive method is employed. Accordingly, the source driver 300 inverts the voltage polarity of the data signal S(i) being applied to each source bus line SLi, every two horizontal scanning periods.

Here, the potential (midpoint potential) Vc to be referenced to invert the polarity of the voltage being applied to the source bus lines SL1 to SLn is at the DC level (the potential corresponding to the DC component) of the data signals S(1) to S(n), and this DC level generally does not match the DC level of the common electrode Ec, and differs from the DC level of the common electrode Ec by a level shift (field-through voltage) ΔVd due to a parasitic capacitance Cgd between the gate and the drain of the TFT in each pixel formation portion. Note that only when the level shift ΔVd due to the parasitic capacitance Cgd is sufficiently lower than optical threshold voltage Vth of the liquid crystal, the DC level of the data signals S(1) to S(n) can be considered to be equal to the DC level of the common electrode Ec, and therefore it can be conceived that the polarities of the data signals S(1) to S(n), i.e., the polarities of the voltage being applied to the source bus lines SL1 to SLn, are inverted every horizontal scanning period with reference to the potential Vcom of the common electrode Ec.

Figure 3:
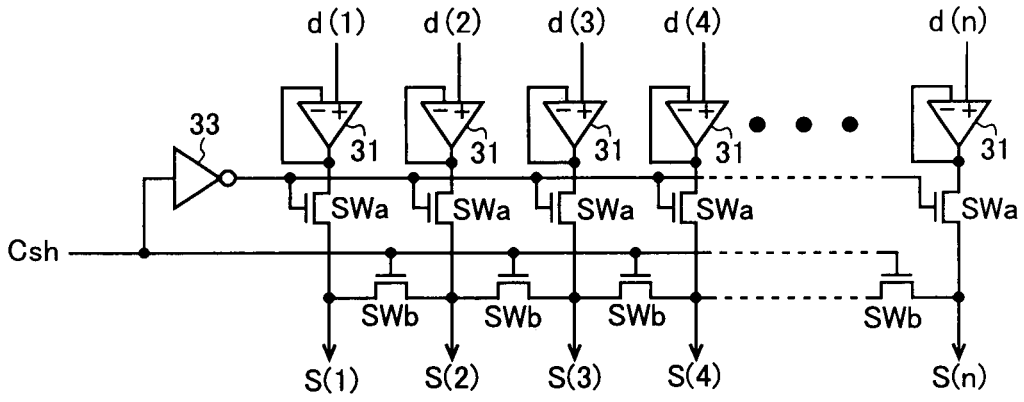
FIG. 3 is a circuit diagram illustrating an exemplary configuration of an output portion of a source driver in the embodiment.

The liquid crystal display device employs the charge-sharing method in which short circuit is caused between adjacent source bus lines every horizontal scanning period in order to reduce power consumption. Accordingly, an output portion that outputs the data signals S(1) to S(n) in the source driver 300 is configured as shown in FIG. 3. Specifically, the output portion receives analog voltage signals d(1) to d(n), which are generated based on the digital image signal DA, and performs impedance conversion on the analog voltage signals d(1) to d(n), thereby generating the data signals S(1) to S(n) as video signals to be transmitted through the source bus lines SL1 to SLn, and the output portion has n buffers 31 as voltage followers for the impedance conversion. To an output terminal of each buffer 31 a first MOS transistor SWa serving as a switching element is connected, and the data signal S(i) (where i=1, 2, . . . , n) from the buffer 31 is outputted from the output terminal of the source driver 300 via the first MOS transistor SWa. In addition, adjacent output terminals in the source driver 300 are connected by a second MOS transistor SWb serving as a switching element. Moreover, the short-circuit control signal Csh is given to the gate terminal of the second MOS transistor SWb between the output terminals, whereas the output signal of the inverter 33, i.e., a logically-inverted signal to the short-circuit control signal Csh is given to the gate terminal of the first MOS transistor SWa connected to the output terminal of the buffer 31. Accordingly, when the short-circuit control signal Csh is inactive (low level), the first MOS transistor SWa is turned "ON", whereas the second MOS transistor SWb is turned "OFF", and therefore the data signal from the buffer 31 is outputted from the source driver 300 via the first MOS transistor SWa. On the other hand, when the short-circuit control signal Csh is active (high level), the first MOS transistor SWa is turned "OFF", whereas the second MOS transistor SWb is turned "ON", and therefore the data signal from the buffer 31 is not outputted, so that short circuit occurs between adjacent source bus lines in the display portion 100 via the second MOS transistor SWb. In the present embodiment, an adjacent video signal line short-circuit portion is achieved by the above-described configuration. Note that the above configuration, in which short circuit is caused to occur between adjacent source bus lines as the polarity of the data signal is inverted, thereby causing the voltage on each source bus line to approximate black voltage, is conventionally proposed as a means for reducing power consumption, and the configuration shown in FIG. 3 is not restrictive.

The gate driver 400 sequentially selects the gate bus lines GL1 to GLm for approximately one horizontal scanning period within each frame period based on the gate start pulse signal GSP, the gate clock signal GCK, and the gate driver output control signal GOE in order to write the data signals S(1) to S(n) to their respective pixel formation portions (pixel capacitances).

<2. Drive Method>

Figures 4A, 4B, 4C:
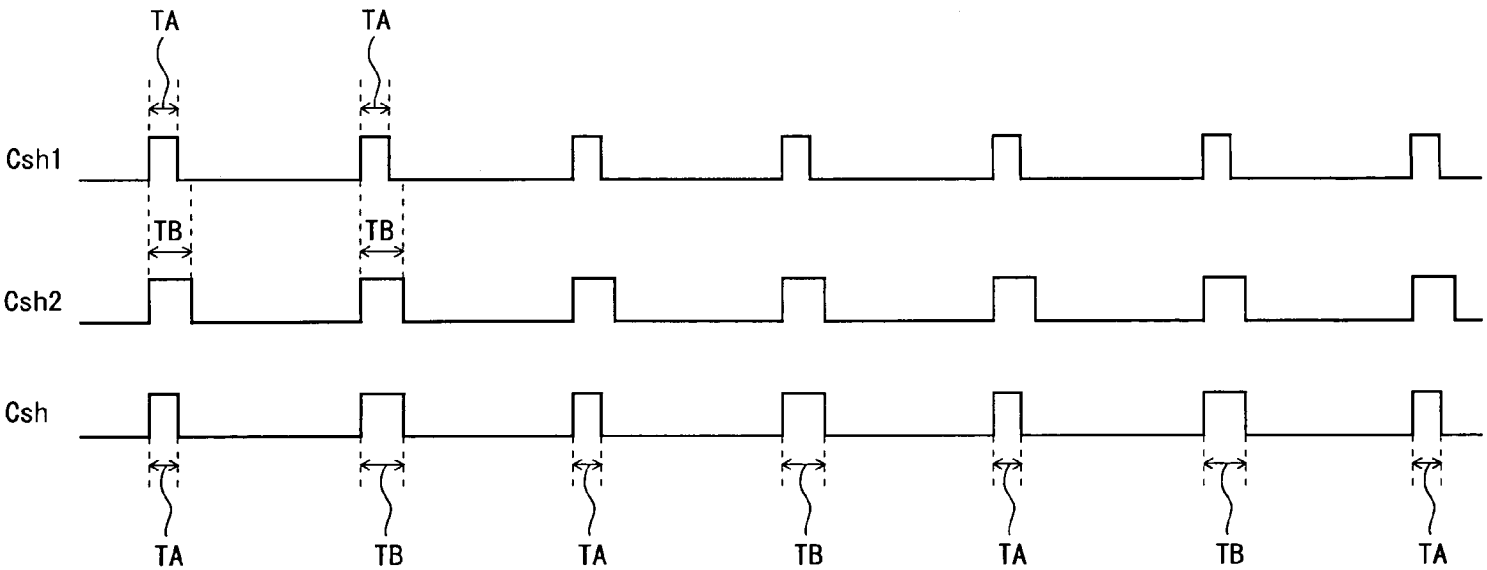
FIGS. 4A to 4C are signal waveform diagrams for explaining generation of a short-circuit control signal in the embodiment.

Next, the drive method in the present embodiment will be described. FIGS. 4A to 4C are signal waveform diagrams for explaining generation of the short-circuit control signal Csh to be sent from the display control circuit 200 to the source driver 300. In the present embodiment, a first short-circuit control signal Csh1 that is brought into high level for a period TA per horizontal scanning period as shown in FIG. 4A, and a second short-circuit control signal Csh2 that is brought into high level for a period TB per horizontal scanning period as shown in FIG. 4B are generated in the display control circuit 200. The first short-circuit control signal Csh1 and the second short-circuit control signal Csh2 are then alternately selected every horizontal scanning period, and the selected signal is outputted from the display control circuit 200 as the short-circuit control signal Csh. As a result, the short-circuit control signal Csh sent from the display control circuit 200 to the source driver 300 has a waveform as shown in FIG. 4C.

FIGS. 1A to 1E are signal waveform diagrams where white display is being performed in the present embodiment. The 1H period will be described first. When a gate signal G (2k−1) rises, its logic level continues to be high for a period TH. In addition, the logic level of the short-circuit control signal Csh is caused to be high for a period TA (hereinafter, referred to as a "first charge-sharing period") from the rise of the gate signal G (2k−1). Here, during the first charge-sharing period in which the short-circuit control signal Csh is at high level, the buffers 31 provided in the output portion of the source driver 300 shown in FIG. 3 are shut off from their corresponding source bus lines, so that adjacent source bus lines are short-circuited. Also, since the present embodiment employs the 2-line dot-inversion drive method, the adjacent source bus lines are opposite in voltage polarity to each other, and furthermore, their voltage absolute values are approximately equal. Accordingly, the voltage of the data signal S(i), which is (negative) white voltage, approximates black voltage during the first charge-sharing period. However, the length of the first charge-sharing period TA is insufficient, and therefore the voltage of the data signal S(i) does not completely conform with black voltage. After the first charge-sharing period, a signal generated based on the digital image signal DA sent from the display control circuit 200 to the source driver 300 is applied to the source bus line. Accordingly, the voltage of the data signal S(i) rises to (positive) white voltage. As a result, charging the pixel capacitances of the pixel formation portions in the (2k−1)'th row is performed by spending a period TH-TA.

Next, the 2H period will be described. When a gate signal G (2k) rises, its logic level continues to be high for a period TH. In addition, the logic level of the short-circuit control signal Csh is caused to be high for a period TB (hereinafter, referred to as a "second charge-sharing period") from the rise of the gate signal G (2k). Since the second charge-sharing period TB is longer than the first charge-sharing period TA, the voltage of the data signal S(i) conforms with black voltage or voltage close to the black voltage during the second charge-sharing period. After the second charge-sharing period, the voltage of the data signal S(i) rises to (positive) white voltage. As a result, charging the pixel capacitances of the pixel formation portions in the 2k'th row is performed by spending a period TH-TB.

Note that, regarding the period TH in which the gate signal is "ON" (the period in which the logic level is high), the first charge-sharing period TA, and the second charge-sharing period TB, correlations therebetween are determined in accordance with device specifications. For example, the first charge-sharing period TA is set to be one-eighth in length of the period TH in which the gate signal is "ON". Also, the second charge-sharing period TB is preferably set to be typically less than or equal to twice the length of the first charge-sharing period TA. For example, the second charge-sharing period TB is set to be 1.6 times the length of the first charge-sharing period TA.

<3. Effects>

While the liquid crystal display device according to the present embodiment employs both the 2-line dot-inversion drive method and the charge-sharing method, conventional liquid crystal display devices employing the same methods has display irregularities generated per line due to the charging rate in the 2H period being higher than that in the 1H period. On the other hand, according to the present embodiment, the second charge-sharing period TB is set to be longer than the first charge-sharing period TA. As a result, the charge period TH-TB for the pixel formation portions to be charged in the 2H period is shorter than the charge period TH-TA for the pixel formation portions to be charged in the 1H period. In addition, the voltage of the data signal S(i) at the beginning of charging in the 2H period is lower than in the conventional art. As a result, the charging rate in the 2H period is lower than in the conventional art, so that the charging rates in the 1H and 2H periods approximate each other. As a result, display irregularities as conventionally occur per line are eliminated. In addition, since the 2-line dot-inversion drive method and the charge-sharing method are employed, it is possible to prevent increase in heat generation and power consumption.

Also, as described above, the first charge-sharing period TA and the second charge-sharing period TB are determined in accordance with device specifications. In other words, the first charge-sharing period TA and the second charge-sharing period TB can be adjusted in length to equalize the charging rates in the 1H and 2H periods, thereby eliminating display irregularities.

<4. Variant>

The above embodiment has been described taking as an example the liquid crystal display device employing the 2-line dot-inversion drive method, but the present invention is not limited to this, and is also applicable to liquid crystal display devices employing a dot-inversion drive method for a plurality of lines in which inversion is performed in units of three lines or more. As an example thereof, a method for driving a liquid crystal display device employing a three-line dot-inversion drive method will be described.

Figures 5A, 5B, 5C:
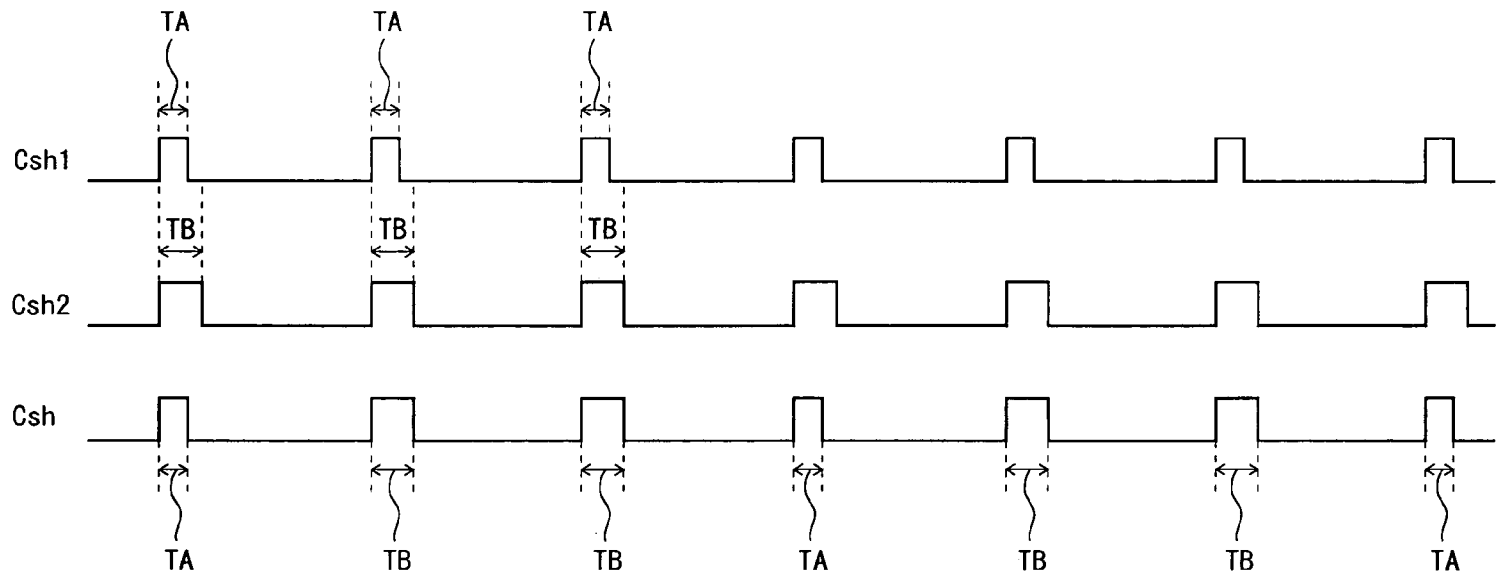
FIGS. 5A to 5C are signal waveform diagrams for explaining generation of a short-circuit control signal in a variant of the embodiment.
Figures 6A, 6B, 6C, 6D, 6E, 6F:
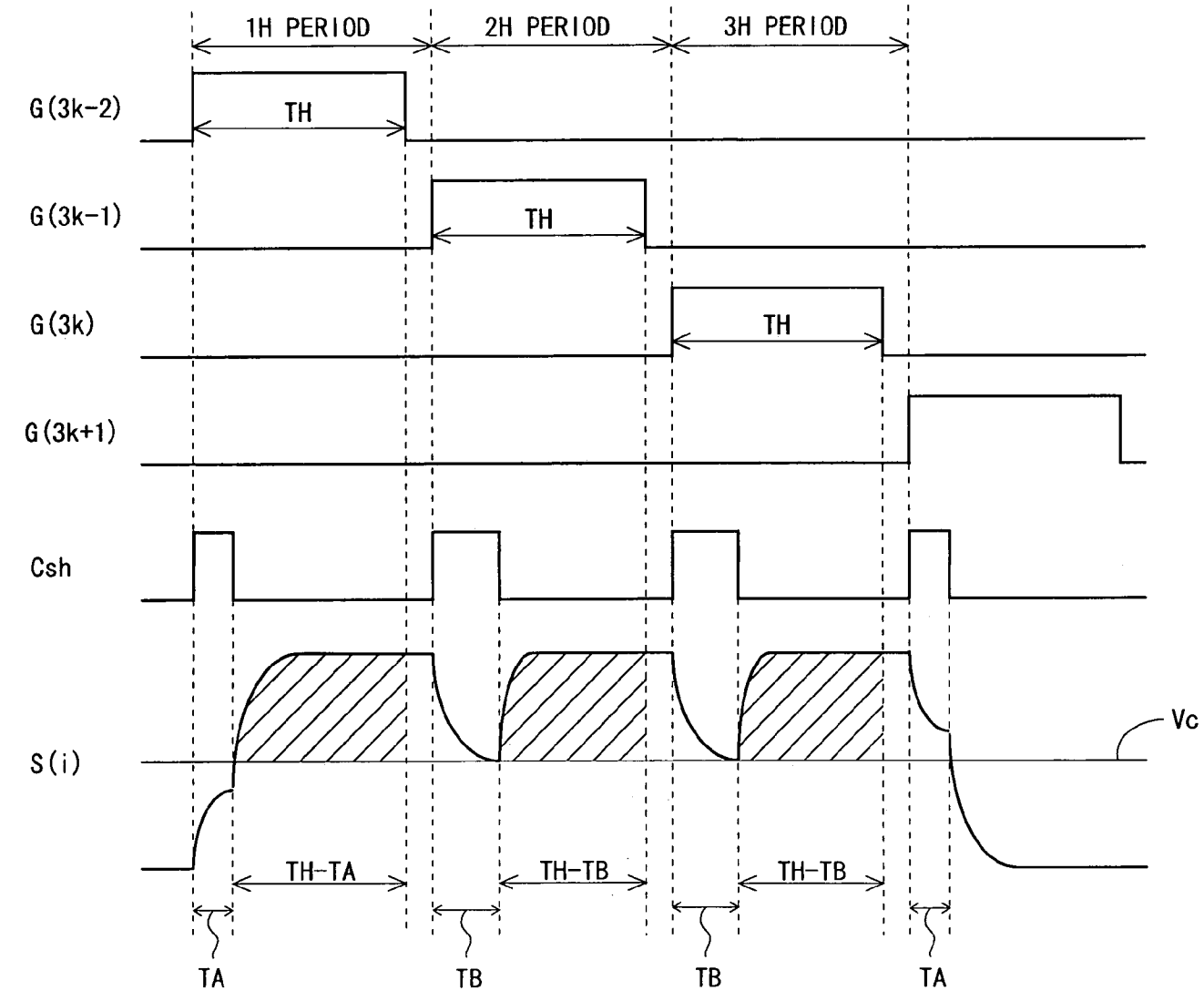
FIGS. 6A to 6F are signal waveform diagrams where white display is being performed in a liquid crystal display device according to the variant of the embodiment.
Figures 9A, 9B, 9C, 9D, 9E:
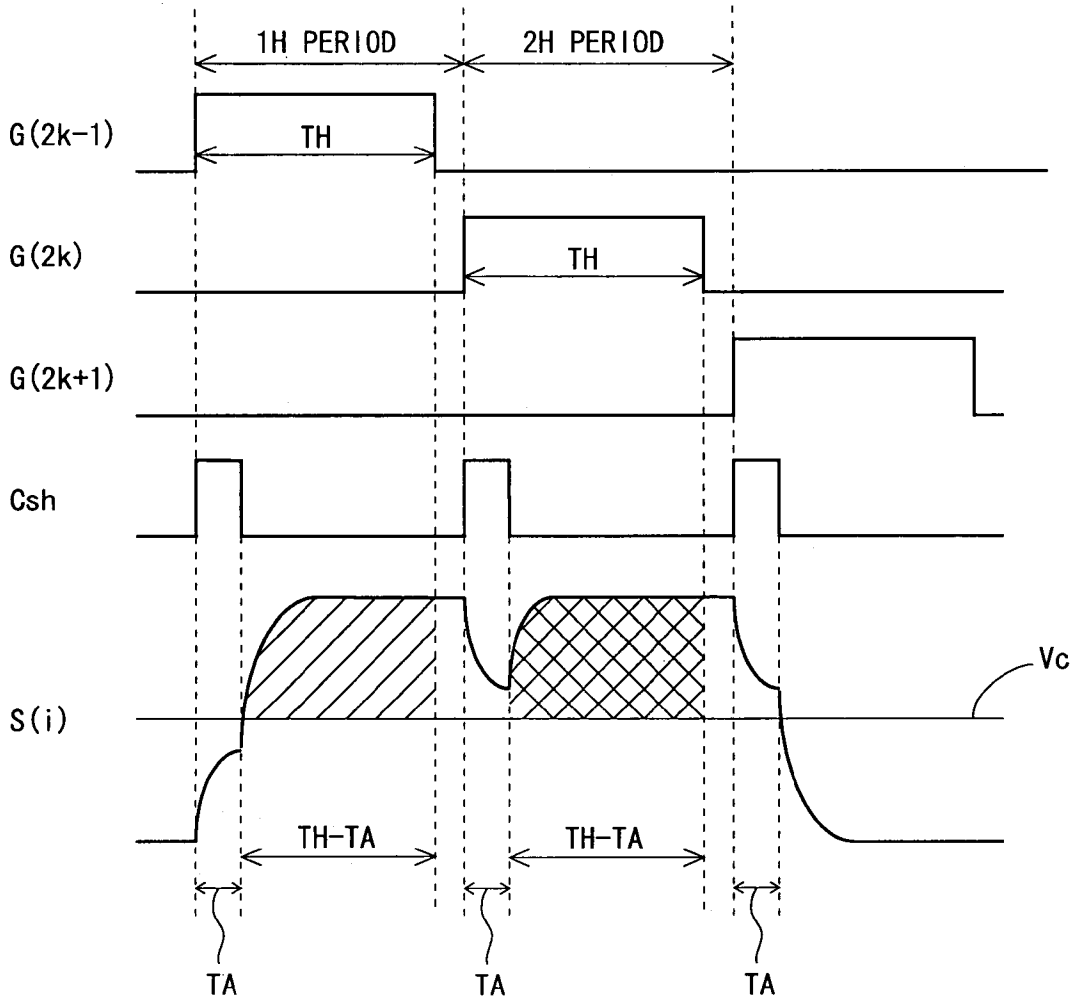
FIGS. 9A to 9E are signal waveform diagrams where white display is being performed in a conventional device.

FIGS. 5A to 5C are signal waveform diagrams for explaining generation of the short-circuit control signal Csh in the present variant. In the present variant, as in the above embodiment, the first short-circuit control signal Csh1, which is brought into high level for the first charge-sharing period TA per horizontal scanning period as shown in FIG. 5A, and the second short-circuit control signal Csh2, which is brought into high level for the second charge-sharing period TB per horizontal scanning period as shown in FIG. 5B, are generated in the display control circuit 200. However, in the present variant, unlike in the above embodiment, the first control signal Csh1 or the second short-circuit control signal Csh2 is selected per horizontal scanning period in the order: Csh1, Csh2, Csh2, Csh1, Csh2, Csh2, and so on. Thus, the waveform of the short-circuit control signal Csh sent from the display control circuit 200 to the source driver 300 is as shown in FIG. 5C.

FIGS. 6A to 6F are signal waveform diagrams where white display is being performed in the present variant. In the 1H period, the voltage of the data signal S(i) does not completely conform with black voltage at the end of the charge-sharing period. Then, after the charge-sharing period, charging the pixel formation portions of the pixel capacitances in the (3k−2)'th row is performed by spending a period TH-TA. In the 2H period, the voltage of the data signal S(i) conforms with black voltage or voltage close to the black voltage at the end of the charge-sharing period. Then, after the charge-sharing period, charging the pixel formation portions of the pixel capacitances in the (3k−1)'th row is performed by spending a period TH-TB. Similarly, after the 3H charge-sharing period, charging the pixel formation portions of the pixel capacitances in the 3k'th row is performed by spending a period TH-TB.

According to the present variant, the 2H and 3H charge-sharing periods are set to be longer than the 1H charge-sharing period. Therefore, the 2H and 3H charge periods TH-TB are shorter than the 1H charge period TH-TA. In addition, in the 2H and 3H periods, the voltage of the data signal S(i) at the beginning of charge is lower than conventionally. As a result, the charging rate is lower in the 2H and 3H periods than conventionally, so that the charging rate in the 1H period approximates the 2H and 3H charging rates. Thus, in the case of the liquid crystal display device employing the three-line dot-inversion drive method also, display irregularities as conventionally occur due to the difference in the charging rate between lines are eliminated.

As described above, by setting the charge-sharing period of the horizontal scanning period with the data signal S(i) having the same polarity as that in one horizontal scanning period previous thereto to be longer than the charge-sharing period of the horizontal scanning period with the data signal S(i) having an inverse polarity to that in one horizontal scanning period previous thereto, it becomes possible to eliminate display irregularities due to the difference in the charging rate between lines in liquid crystal display devices employing both a multiple-line dot-inversion drive method and the charge-sharing method.

The invention claimed is:

1. An active matrix-type display device comprising:

a plurality of video signal lines configured to respectively transmit a plurality of video signals representing an image to be displayed;

a plurality of scanning signal lines crossing the video signal lines;

a plurality of pixel formation portions arranged in a matrix in association with intersections of the video signal lines and the scanning signal lines;

a video signal line drive circuit configured to supply the video signals to the video signal lines over a plurality of horizontal scanning periods such that video signals being applied to adjacent video signal lines have different polarities, and the video signal line drive circuit is configured such that the polarity of each video signal is inverted periodically at an interval of time equal to multiple horizontal scanning periods, from among the plurality of horizontal scanning periods, within each frame period;

a scanning signal line drive circuit configured to sequentially select the scanning signal lines per a predetermined horizontal scanning period, from among the plurality of horizontal scanning periods,. within each frame period; and an adjacent video signal line short-circuit portion provided inside or outside the video signal line drive circuit, the adjacent video signal line short-circuit portion being configured to short-circuit the adjacent video signal lines for a preset charge-sharing period from the start of each of the plurality of horizontal scanning periods, the active-matrix display device being configured such that a second charge-sharing period, which is the charge-sharing period within a first horizontal scanning period is longer in time than a first charge-sharing period, which is the charge-sharing period within a second horizontal scanning period, wherein the first horizontal scanning period is a horizontal scanning period from among the plurality of horizontal scanning periods in which the polarity of each video signal is the same as that in one horizontal scanning period previous to the first horizontal scanning period in the plurality of horizontal scanning periods, and the second horizontal scanning period is a horizontal scanning period from among the plurality of horizontal scanning periods in which the polarity of each video signal is different from that in one horizontal scanning period previous to the second horizontal scanning period in the plurality of horizontal scanning periods.

2. The display device according to claim 1, wherein the second charge-sharing period is set to be less than or equal to twice the length of the first charge-sharing period.

3. The display device according to claim 1, wherein the video signal line drive circuit is configured to supply the video signals to the video signal lines such that the polarity of each video signal is inverted per two horizontal scanning periods, from among the plurality of horizontal scanning periods, within each frame period.

4. The display device according to claim 1, wherein the active-matrix display device is configured such that the first charge-sharing period and the second charge-sharing period are set such that a charging rate for each pixel formation portion during the first horizontal scanning period is equal to a charging rate for the pixel formation portion during the second horizontal scanning period.

5. A drive circuit for an active matrix-type display device including a plurality of video signal lines for respectively transmitting a plurality of video signals representing an image to be displayed; a plurality of scanning signal lines crossing the video signal lines; and a plurality of pixel formation portions arranged in a matrix in association with intersections of the video signal lines and the scanning signal lines, the circuit comprising:

a video signal line drive circuit configured to supply the video signals to the video signal lines over a plurality of horizontal scanning periods such that video signals being applied to adjacent video signal lines have different polarities, and the video signal line drive circuit is configured such that the polarity of each video signal is inverted periodically at an interval of time equal to multiple horizontal scanning periods, from among the plurality of horizontal scanning periods within each frame period;

a scanning signal line drive circuit configured to sequentially select the scanning signal lines per a predetermined horizontal scanning period, from among the plurality of horizontal scanning periods, within each frame period; and an adjacent video signal line short-circuit portion configured to short-circuit the adjacent video signal lines for a preset charge-sharing period from the start of each of the plurality of horizontal scanning periods, wherein the drive circuit is configured such that a second charge-sharing period, which is the charge-sharing period within a first horizontal scanning period is longer in time than a first charge-sharing period, which is the charge-sharing period within a second horizontal scanning period, wherein the first horizontal scanning period is a horizontal scanning period from among the plurality of horizontal scanning periods in which the polarity of each video signal is the same as that in one horizontal scanning period previous to the first horizontal scanning period in the plurality of horizontal scanning periods, and the second horizontal scanning period is a horizontal scanning period from among the plurality of horizontal scanning periods in which the polarity of each video signal is different from that in one horizontal scanning period previous to the second horizontal scanning period in the plurality of horizontal scanning periods.

6. The drive circuit according to claim 5, wherein the second charge-sharing period is set to be less than or equal to twice the length of the first charge-sharing period.

7. The drive circuit according to claim 5, wherein the video signal line drive circuit is configured to supply the video signals to the video signal lines such that the polarity of each video signal is inverted per two horizontal scanning periods, from among the plurality of horizontal scanning periods, within each frame period.

8. The drive circuit according to claim 5, wherein the drive circuit is configured such that the first charge-sharing period and the second charge-sharing period are set such that a charging rate for each pixel formation portion during the first horizontal scanning period is equal to a charging rate for the pixel formation portion during the second horizontal scanning period.

9. A drive method for an active matrix-type display device including a plurality of video signal lines for respectively transmitting a plurality of video signals representing an image to be displayed; a plurality of scanning signal lines crossing the video signal lines; and a plurality of pixel formation portions arranged in a matrix in association with intersections of the video signal lines and the scanning signal lines, the method comprising:

a video signal line drive step of supplying the video signals to the video signal lines over a plurality of horizontal scanning periods such that video signals being applied to adjacent video signal lines have different polarities, and the polarity of each video signal is inverted periodically at an interval of time equal to multiple horizontal scanning periods, from among the plurality of horizontal scanning periods within each frame period;

a scanning signal line drive step of sequentially selecting the scanning signal lines per a predetermined horizontal scanning period, from among the plurality of horizontal scanning periods, within each frame period; and an adjacent video signal line short-circuit step of short-circuiting the adjacent video signal lines for a preset charge-sharing period from the start of each of the plurality of horizontal scanning periods, wherein a second charge-sharing period, which is the charge-sharing period within a first horizontal scanning period is longer in time than a first charge-sharing period, which is the charge-sharing period within a second horizontal scanning period, wherein the first horizontal scanning period is a horizontal scanning period from among the plurality of horizontal scanning periods in which the polarity of each video signal is the same as that in one horizontal scanning period previous to the first horizontal scanning period in the plurality of horizontal scanning periods, and the second horizontal scanning period is a horizontal scanning period from among the plurality of horizontal scanning periods in which the polarity of each video signal is different from that in one horizontal scanning period previous to the second horizontal scanning period in the plurality of horizontal scanning periods.

10. The drive method according to claim 9, wherein the second charge-sharing period is set to be less than or equal to twice the length of the first charge-sharing period.

11. The drive method according to claim 9, wherein in the video signal line drive step, the video signals are supplied to the video signal lines such that the polarity of each video signal is inverted per two horizontal scanning periods, from among the plurality of horizontal scanning periods, within each frame period.

12. The drive method according to claim 9, wherein the first charge-sharing period and the second charge-sharing period are set such that a charging rate for each pixel formation portion during the first horizontal scanning period is equal to a charging rate for the pixel formation portion during the second horizontal scanning period.

* * * * *